US005309813A

United States Patent [19]

Henley

[11] Patent Number: 5,309,813

[45] Date of Patent: May 10, 1994

[54] SEMI-AUTOMATIC AMMUNITION CASE PROCESSING APPARATUS

[76] Inventor: Roy J. Henley, 617 S. Adams, Stillwater, Okla. 74074-4322

[21] Appl. No.: 108,072

[22] Filed: Aug. 17, 1993

[51] Int. Cl.[5] ..... F42B 33/02

[52] U.S. Cl. ..... 86/23; 86/24; 86/28; 86/36; 86/37; 29/1.32

[58] Field of Search ..... 86/36, 37, 23, 28, 24; 29/1.32

[56] References Cited

U.S. PATENT DOCUMENTS

| | | | |
|---|---|---|---|
| 3,429,218 | 2/1967 | Olsen | 86/24 |
| 3,818,563 | 6/1972 | Bealieu | 86/24 |
| 4,325,282 | 4/1980 | Schenzer | 86/24 |
| 4,593,598 | 6/1986 | Gunder | 86/36 |
| 4,675,958 | 6/1987 | Rosenbaum et al. | 86/24 |
| 4,686,751 | 4/1986 | Gracey | 86/24 |
| 4,723,472 | 2/1988 | Lee | 86/24 |
| 4,742,606 | 5/1988 | Burby et al. | 29/1.32 |
| 4,813,827 | 3/1988 | Dugger | 86/24 |
| 4,860,453 | 8/1989 | Carroll | 29/1.32 |
| 5,067,383 | 11/1991 | Rowe | 86/23 |
| 5,200,571 | 4/1992 | Gracey | 86/24 |

OTHER PUBLICATIONS

Item #RT 1200B, p. 15 of the Jul. issue of the "Blue Press" catalog, sold by Dillon Precision Products, Inc.

*Primary Examiner*—J. Woodrow Eldred

[57] ABSTRACT

A multifunctional cartridge case processing apparatus for use in the handloading/reloading of ammunition. The apparatus resizing the cartridge case, trims the case to its precise standard length, decaps the cartridge case primer pocket, and evacuates the cartridge case trimmings. The apparatus can adapt to a variety of specific cartridge calibers with the proper selection of sizing ring, guide member and cutter height setting. The apparatus can be used as and integral part of a progressive handloading/reloading press or on a conventional single-stage press.

3 Claims, 7 Drawing Sheets

SEMI-AUTOMATIC AMMUNITION CASE PROCESSING APPARATUS

BACKGROUND

1. Field of The Invention

Figure 1:
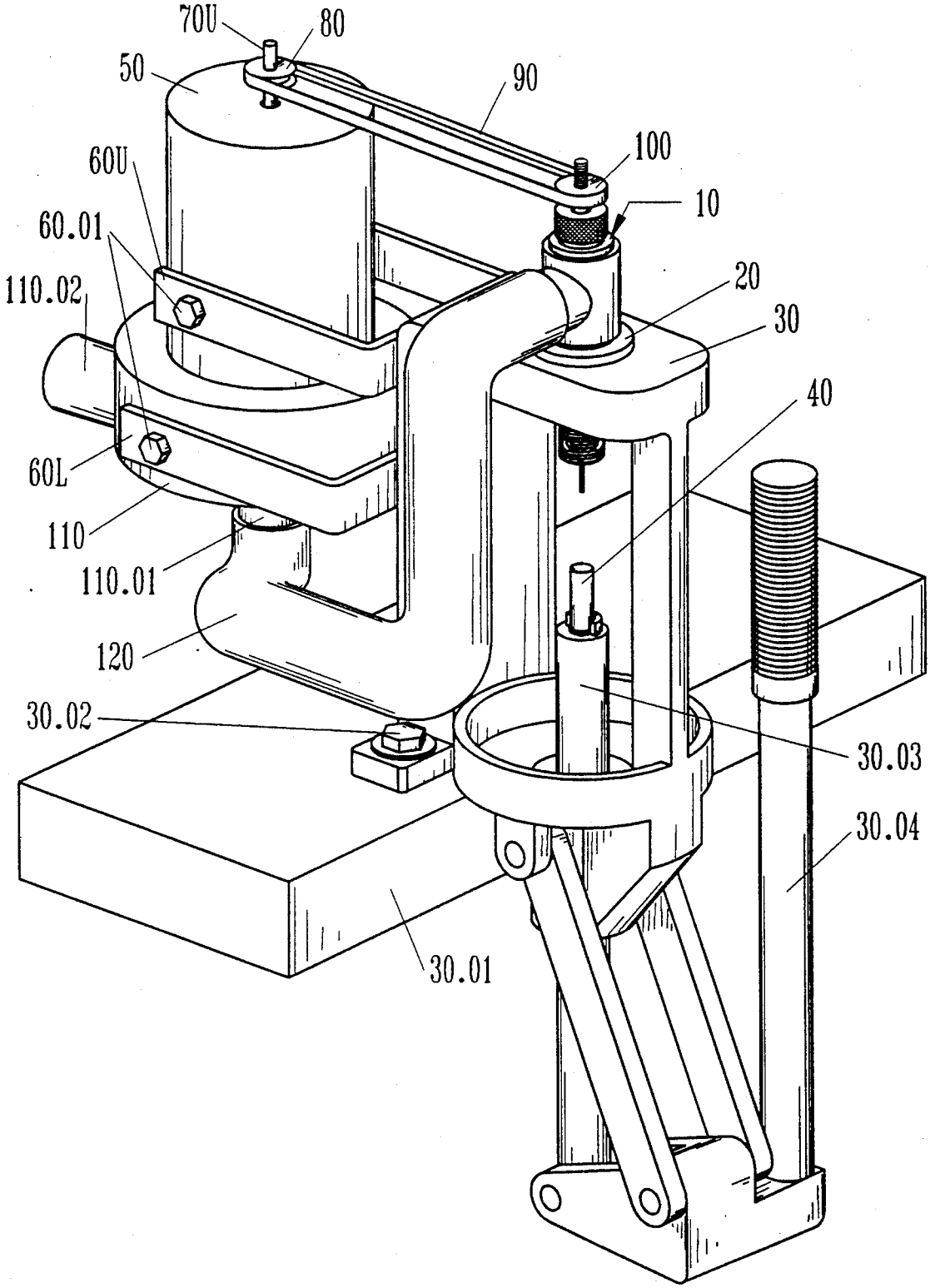

This invention relates to loading (reloading) new or used ammunition, specifically to resizing a cartridge case, trimming the cartridge case back to its original standard length, evacuating the cartridge case trimmings, and decapping the cartridge case primer pocket.

2. Discussion of Prior Art

When a round of ammunition is fired, the cartridge case undergoes plastic radial deformation (expansion). Before the cartridge case can be used again (reloaded), it must be resized in regards to its diameter. Resizing is performed by means of a resizing die mounted on the toolhead of a handloading/reloading press. The resizing die has a precisely sized steel, carbide, tungsten carbide, etc. ring, through which the fired cartridge case is inserted by means of a mechanical force exerted by the press. This resizing process causes plastic radial deformation of the cartridge case, effectively correcting the expansion from firing. However, since the mass of the cartridge case material is conserved, when the cartridge case is resized, it also undergoes axial expansion (grows in length). Over the course of firing/resizing cycles (possibly even one), the standard length dimension of the cartridge case will eventually be exceeded, therefore if the cartridge case is to be functional, sometime in the firing/resizing cycle the cartridge case must be trimmed back to its original standard length. In fact, even if the cartridge case is within functional tolerances after resizing, case to case length variations in conventional reloaded ammunition can and will cause variations in the bullets' point of impact. This variation in cartridge case length causes a variation in the bullet seating depth and the amount of bullet crimp when the case is reloaded, which leads to slight variations in pressure at firing, resulting in variations at point of impact between shots. The end result usually manifests itself in the form of vertical stringing in a group of shots.

Another detriment of cartridge case length variation manifests itself at the cartridge case expanding step in the reloading process. Before a bullet can be seated in a charged cartridge case (a case that has been resized, primed, and filled with an appropriate amount of gun powder), the mouth of the cartridge case must be expanded in order to accept the bullet. Expansion of the cartridge case mouth is performed by the insertion of a flared cylindrical tool into the case mouth to a precise depth. Due to the nature of the case mouth expanding mechanism, it can only be set-up for one exact case length. When in the process of reloading, a particular cartridge case is even slightly longer than the case used in the set-up process, then that particular cartridge case will be expanded too much, excessive coldwork (expansion) of the cartridge case material will cause cracks or splits in the case mouth and shorten the case life or even result a rupture of the cartridge case at detonation. If a particular case is shorter than the case used in the set-up process, then that particular case will not be expanded enough and it may not fully accept the bullet, resulting in a collapsed case when the bullet is seated. Both of these scenarios introduce additional variation and could potentially become dangerous. Therefore, as discussed above, it is important that cartridge cases be trimmed back to their original standard length dimension after they have been resized, in order to be reloaded.

U.S. Pat. No. 4,325,282 to Mark Schaenzer (1980) discloses a combination metal-forming/case-trimming die which can effectively resize and trim the spent cartridge case to length, however this apparatus is not motorized nor does it provide a way to evacuate the cartridge case trimmings produced by the trimming process. Cartridge case trimmings which are not removed, will work there way into the resizing section of the die, increasing the force required to fully the insert the cartridge case and damaging the exterior case wall. Other patents for cartridge case trimming include; U.S. Pat. No. 3,818,563 to Richard G. Beaulieu (1972); U.S. Pat. No. 4,686,751 to Doyle D. Gracey (1986); and U.S. Pat. No. 4,813,827 to William D. Dugger (1988); however, none of these cartridge case trimming devices are integrated into resizing or any other reloading process.

Item number RT 1200B on page 15 of the Blue Press catalog (July 1993), sold by Dillon Precision Products, Inc., sizes the cartridge case, trims the case to length via a motor driven cutter, and provides a vacuum manifold for the removal of the cartridge case trimmings. However, this apparatus requires a separate vacuum motor for the evacuation of case trimmings and due to the positioning of the motor, it will not work in conjunction with other components of a progressive reloading press. There are at least four steps (some of which are a combination of operations) that must performed on a cartridge case in order to reload it:

1. resize the cartridge case and decap the spent primer,
2. reprime the primer pocket, expand case mouth, and fill with gun powder;
3. manually place the bullet on the expanded case and seat the bullet; and
4. crimp the cartridge case to secure the bullet in place.

As opposed to a conventional single-stage handloading-/reloading press (which has a single-die toolhead), the toolhead of a progressive handloading/reloading press has four or more die stations, one die station for each of the above steps. Together with some additional features, a progressive handloading/reloading press can essentially perform all of the above mentioned steps with a single cycle of the press operating handle, because the cartridge cases are automatically indexed from station to station. This greatly reduces the time and effort required to reload ammunition. A single-stage handloading/reloading press requires at least one cycle of the press handle for each of the above mentioned steps, plus time to change and adjust the dies between operations. Therefore, with a progressive press performing so many operations at once, the toolhead of a progressive handloading/reloading press is cluttered. Since the motor and the large vacuum manifold of the Dillon size/trim die sit just above the toolhead, there is insufficient space for the other dies and attachments required to progressively reload ammunition. If the Dillon sizing/trimming die is used, it must be used by itself on the press and then completely removed before subsequent reloading operations can be carried out, thus defeating the purpose of the progressive reloading machine. That purpose being to reload ammunition with a single cycle of the press handle, rather than the customary four or more press handle cycles required by a conventional single-stage press (as such, the Dillon method requires two handle cycles per round). Another disadvantage to the Dillon sizing/trimming die is that it can only size/trim rifle length cases, because only this type of cartridge case extends above the toolhead, to which the sizing/trimming die is mounted. Due to the design of the Dillon apparatus (possibly based on Pat. No. 4,325,282), the trimming cutter does not extend down into the resizing die, and as such, is not able to reach the shorter pistol length cases since they are shorter than the thickness of a standard handloading-/reloading press toolhead. Therefore, trimming cartridge cases can only be performed by a separate operation and thus interrupting the progressive reloading cycle.

When a round is fired, the bullet and gun powder exit the cartridge case and the only thing left in the spent case is a detonated primer, still in the cartridge case primer pocket. This spent primer must be removed (decapped) before the insertion of a live primer. As is the standard for today, decapping is usually done when the case is resized. When the cartridge case is inserted into the resizing die by means of a mechanical force, the spent primer is dislodged by a coaxially mounted decapping pin which extends from inside the upper portions of the die, through and beyond the lower portion of the die. The primer is pushed out as the decapping pin passes through the cartridge case flash hole (ignition port). However, there is a small amount of residue left in the cartridge case primer pocket. This residue should occasionally be removed. If after several firings, the primer residue is allowed to accumulate, proper seating of the primer will become infeasible. Effects of primer residue accumulation include:

1. high primers, where the primer is not seated to its full depth causing a dangerous exposure of the primer side walls and risking premature detonation,
2. primer seating difficulty, where a new live primer could detonate while being inserted in a used cartridge case, and
3. misfires or delayed detonation, when the firing pin strikes the primer but the primer's anvil is not in direct contact with the bottom of the case primer pocket, resulting in failure to detonate or dangerous delays in primer detonation.

U.S. Pat. No. 3,429,218 to Ole N. Olsen (1967) and U.S. Pat. No. 5,200,571 to Doyle D. Gracey (1992) disclose methods for primer pocket cleaning from hand held manual mechanisms to motorized machine held mechanisms. However, none of these mechanisms are designed in such a fashion to resize the cartridge case, trim to standard length, clean the primer pocket, and remove the case trimmings all in one step. Therefore, to clean the primer pocket of a cartridge case, the cartridge case must be taken out of the progressive reloading cycle.

OBJECTS AND ADVANTAGES

Accordingly, the objects and advantages of the present invention are:

(a) to provide a means whereby the separate operations of resizing the cartridge case, trimming it back to a consistent precise standard length, decapping the case primer pocket, and evacuating the cartridge case trimmings, can all be combined into one step in the process of handloading/reloading ammunition on a progressive or single-stage press;

(b) to provide a means whereby pistol cases as well as rifle cases can be processed in such a manner as mentioned in part (a) above, (c) to provide an apparatus whereby several different cartridge case calibers can be processed using the same basic apparatus by interchanging a few caliber specific parts;

(d) to provide an apparatus that helps to decrease the time and effort required to handload/reload ammunition, (e) to provide a means whereby the handloading-/reloading process produces a safer and more consistent round of ammunition; and (f) to reduce waste and costs by extending the life of cartridge case.

Further objects and advantages will become apparent from a consideration of the ensuing description and drawings.

SUMMARY

An objective of the present invention is to expedite the handloading/reloading of ammunition by combining several operations into a single operation. Those operations are:

1. to resize the cartridge case;
2. to decap the spent primer;
3. to clean the cartridge case primer pocket;
4. to trim the case back to its precise standard length; and
5. to evacuate the cartridge case trimmings.

How the foregoing and other features of the invention are achieved will be evident in the more detailed description of a preferred embodiment of the invention which will now be set forth in reference to the drawings.

DRAWINGS FIGURES

Figure 2:
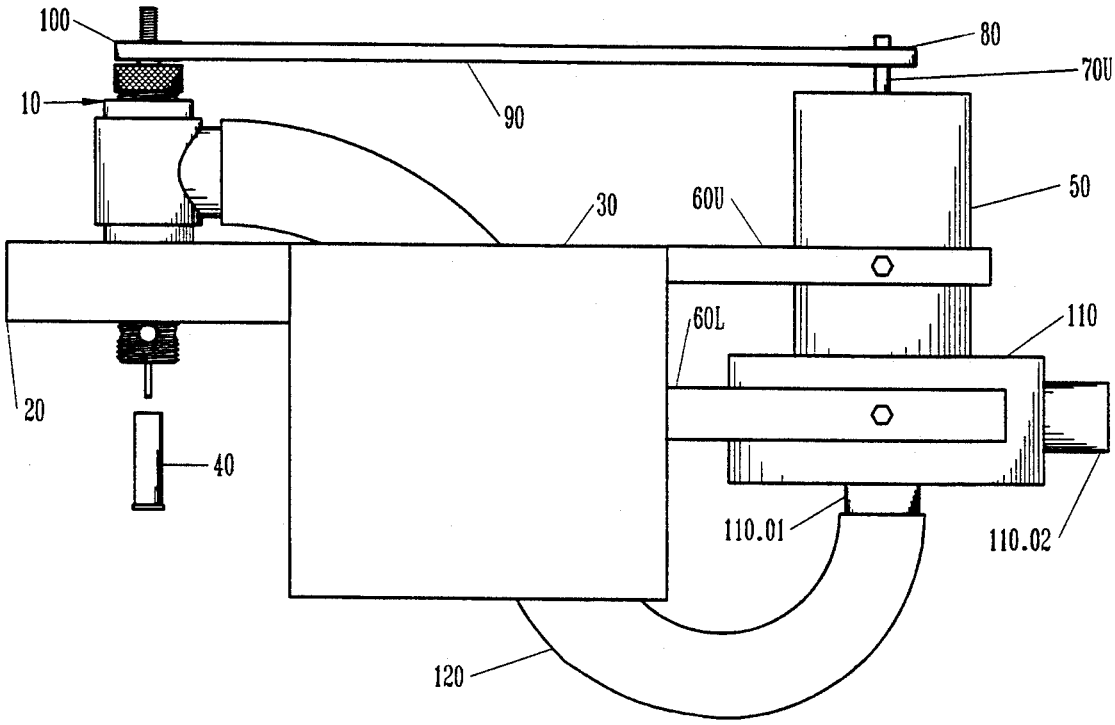
Figure 3:
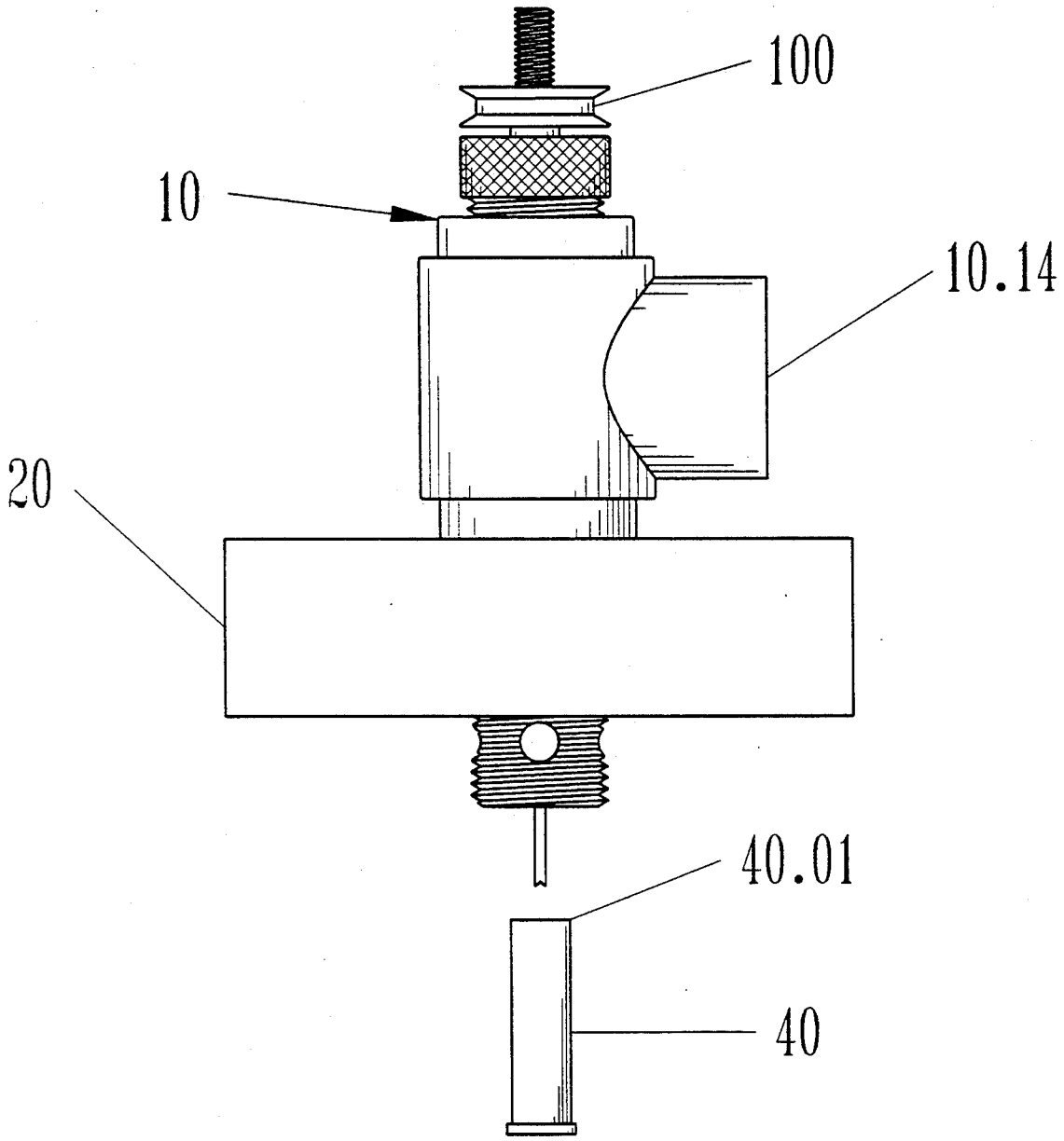
Figure 4:
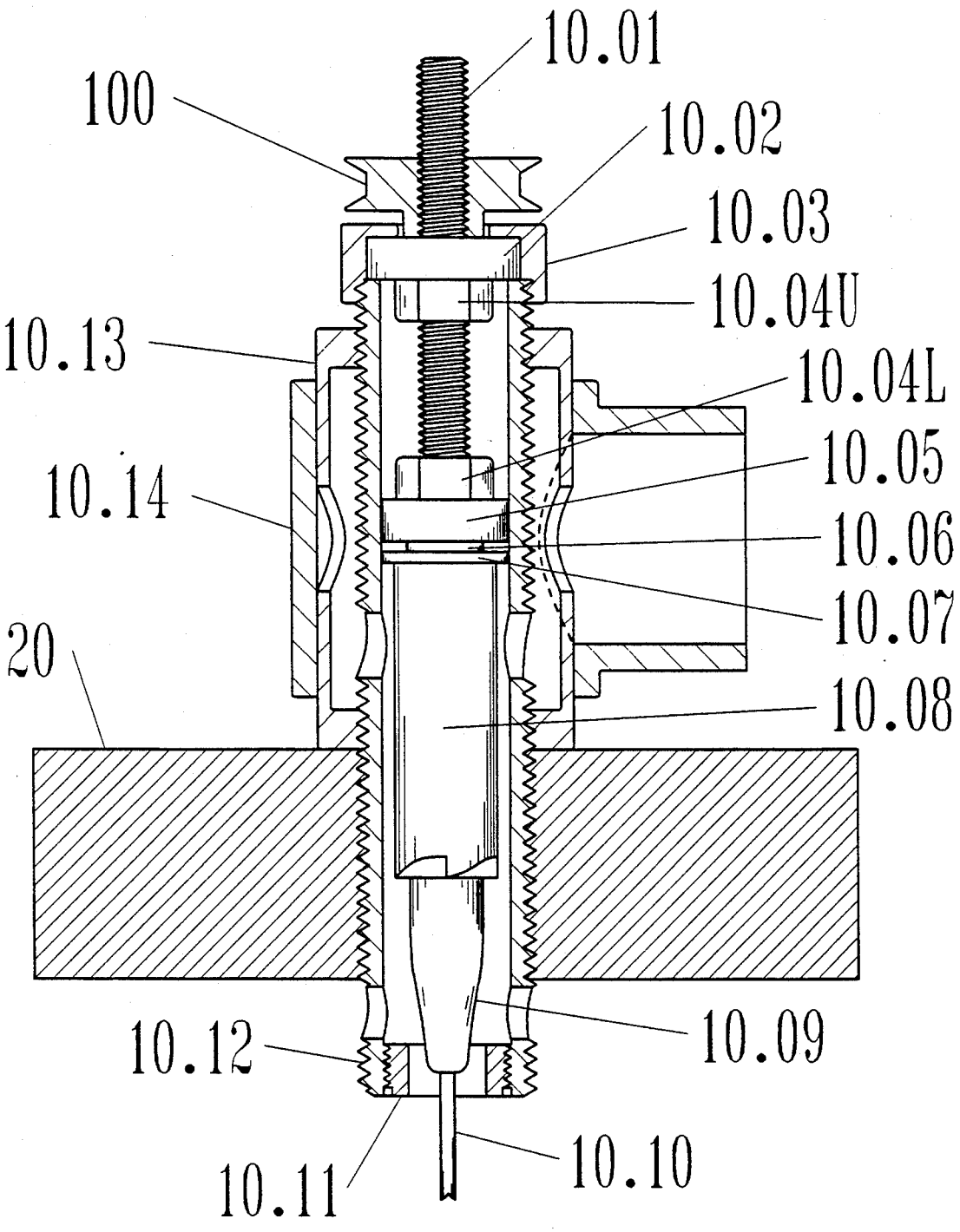
Figure 5:
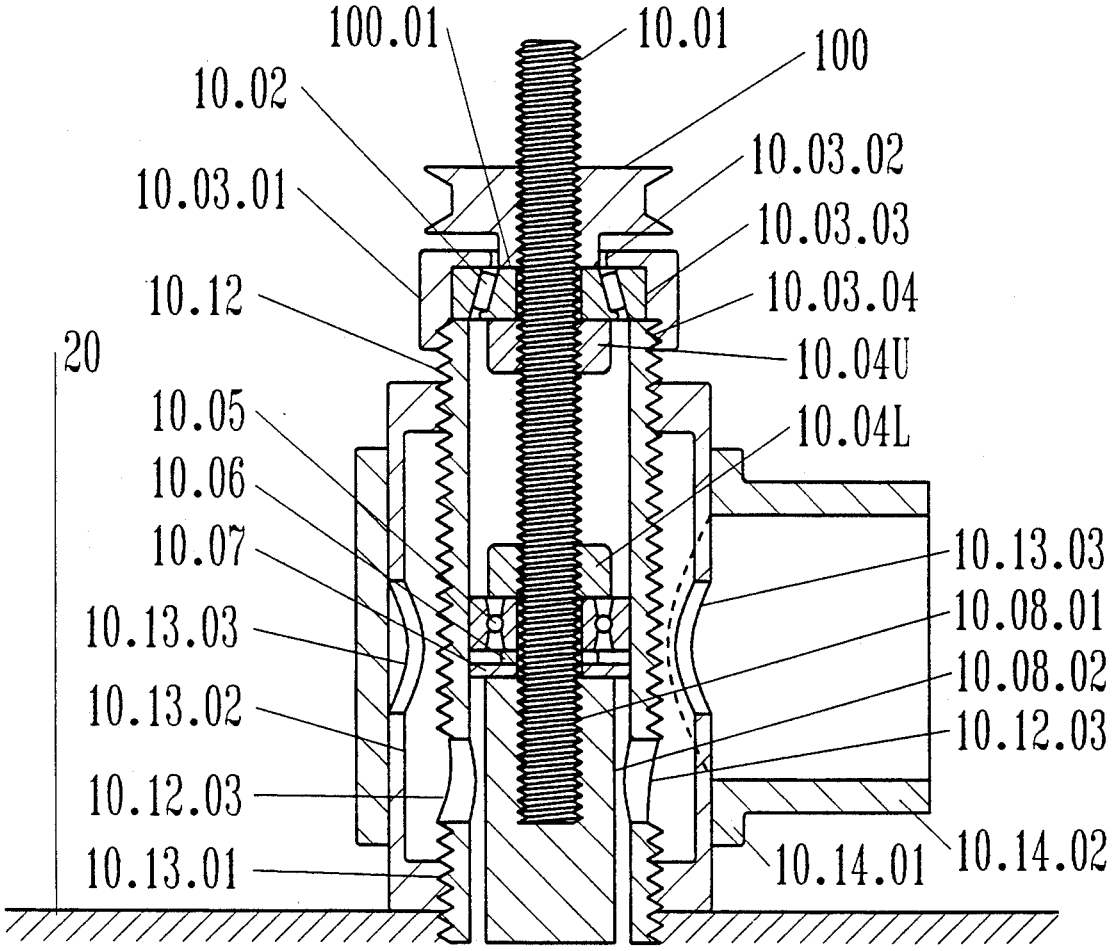
Figure 6:
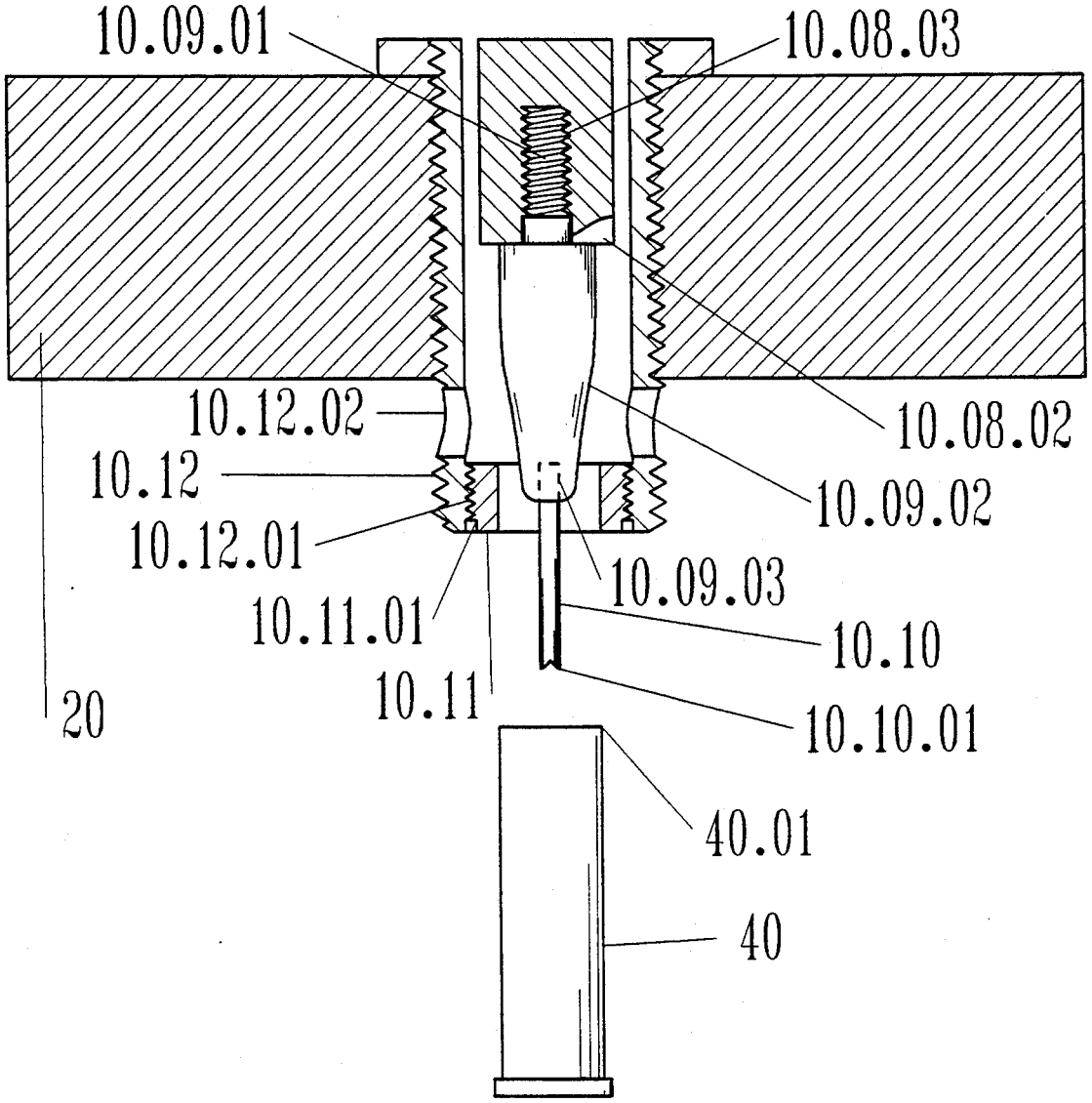
Figure 7:
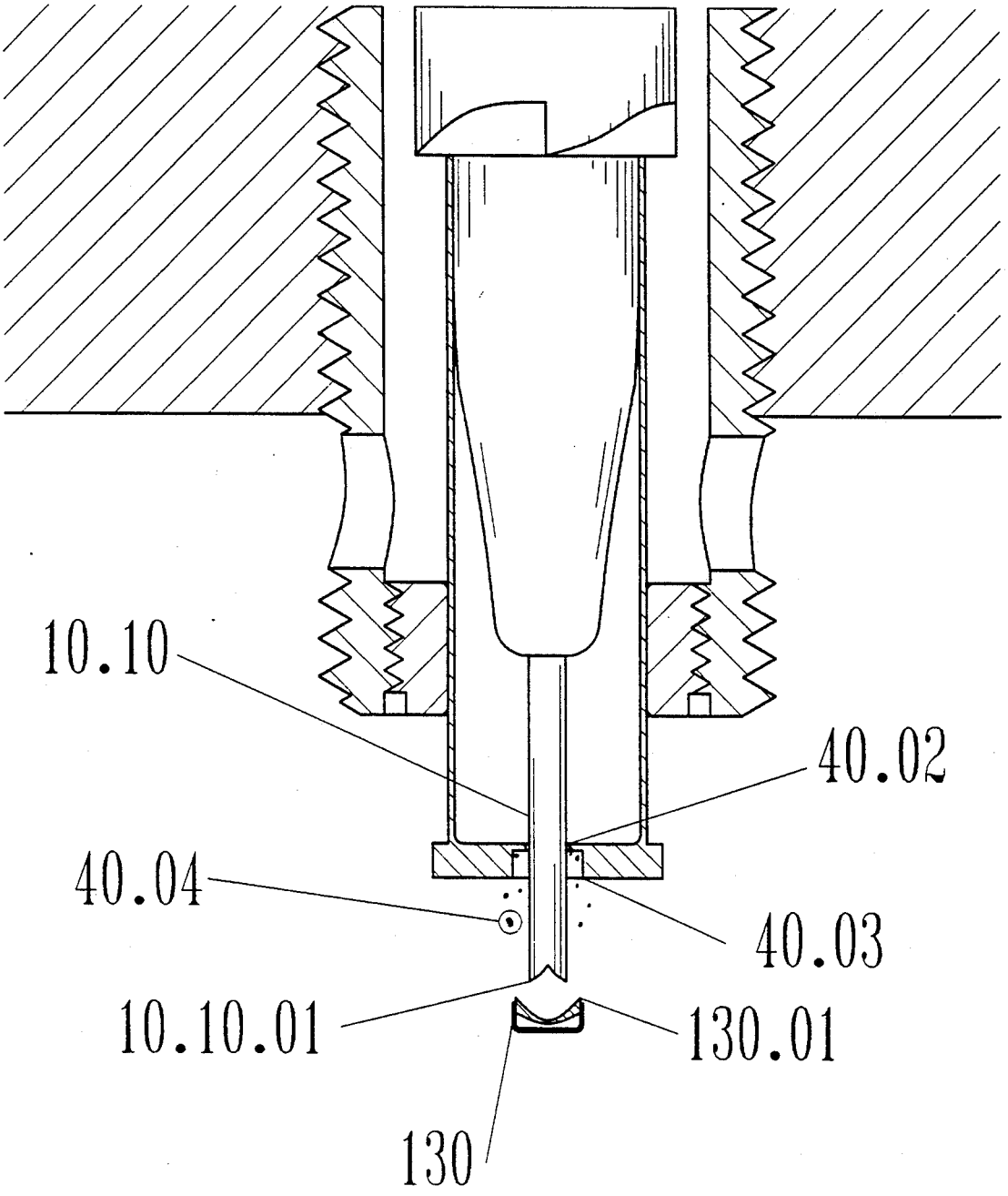

FIG. 1 shows an isometric view of the entire apparatus mounted on a single-stage press FIG. 2 shows a composite side view of the entire apparatus FIG. 3 shows side view of the die assembly mounted on a toolhead FIG. 4 shows a cross-sectional view of the die assembly FIG. 5 shows a cross-sectional view of the top half of the die assembly FIG. 6 shows a cross-sectional view of the bottom half of the die assembly FIG. 7 shows a cross sectional view of a cartridge case and a dislodged spent primer

REFERENCE NUMERALS IN DRAWING

10 die assembly:
- 10.01 coaxial shaft
- 10.02 combination radial/thrust roller bearing
- 10.03 bearing cap
  - 10.03.01 exterior diamond knurl
  - 10.03.02 small through-hole bore
  - 10.03.03 larger bearing bore
  - 10.03.04 threaded lower portion
- 10.04U & 10.04L a set of upper and lower hexagonal nuts
- 10.05 radial type ball bearing
- 10.06 spacer washer
- 10.07 shield washer
- 10.08 trimming/milling cutter
  - 10.08.01 upper internally threaded bore
  - 10.08.02 radial cutting edges
  - 10.08.03 lower internally threaded bore
- 10.09 guide member
  - 10.09.01 threaded external shaft
  - 10.09.02 cylindrical contour 10.09.03 internal bore
10.10 interlocking decapping pin
10.10.01 protrusions
10.11 sizing ring insert
10.11.01 number of radial slots
10.12 multi-ported die body
10.12.01 section of internal threads
10.12.02 radial air-intake holes (ports)
10.12.03 radial air-evacuation holes (ports)
10.13 manifold
10.13.01 lower internally threaded opening
10.13.02 recessed internal bore
10.13.03 radial holes (ports)
10.14 vacuum hose adapter
10.14.01 vertical cylindrical section
10.14.02 horizontal cylindrical section
20 press toolhead
30 handloading/reloading press frame
30.01 work bench
30.02 screws
30.03 ram mechanism
30.04 press handle
40 cartridge case
40.01 case mouth
40.02 flash hole
40.03 case primer pocket
40.04 primer residue
50 electric motor
60U & 60L upper and lower motor mounts
60.01 motor mount screws
70U & 70L upper and lower motor shafts
80 drive wheel
90 drive belt
100 driven wheel
100.01 spacer shaft
110 vacuum generating apparatus
110.01 air intake
110.02 exhaust
120 vacuum hose
130 spent primer
130.01 anvil arms

DESCRIPTION: FIG. 1 AND FIG. 2

A typical embodiment of the entire apparatus of the present invention is illustrated in FIG. 1 and FIG. 2. The drawings illustrate a die assembly 10, a press toolhead 20, a handloading/reloading press frame 30, a cartridge case 40, an electric motor 50, an upper motor mount 60U, a lower motor mount 60L, an upper motor shaft 70U, a drive wheel 80, a drive belt 90, a driven wheel 100, a vacuum generating apparatus 110, and a vacuum hose 120.

Illustrated in FIG. 1, die assembly 10 which will be described in detail below, is joined to press toolhead 20 by industry standard $\frac{7}{8}''\times 14$ threads. Press toolhead 20 will only accept one die at a time if the press is of the single-stage type, or may hold several dies and attachments at the same time if the press is of the progressive type (not shown). Press toolhead 20 is joined to handloading/reloading press frame 30 by any one of a number of methods (threads, interlocking lugs, pinned slots, etc.) specific to a particular make and model of handloading/reloading press. Press toolhead 20 holds die assembly 10 stationary while cartridge case 40 is inserted into and removed from die assembly 10 by mechanical force exerted by ram mechanism 30.03.

Handloading/reloading press frame 30 is secured to work bench 30.01 by screws 30.02. Handloading/reloading press frame 30 supports ram mechanism 30.03 which forces the cartridge case 40 into and out of die assembly 10. In the preferred embodiment, electric motor 50 having a predetermined power and speed rating sufficient for the required operational load, is of the explosion-proof design and is secured to the handloading/reloading press frame 30 by upper motor mount 60U and lower motor mount 60L. Upper and lower motor mounts 60U and 60L are attached to electric motor 50 and to handloading/reloading press frame 30 by a number of motor mount screws 60.01. However, motor mounts 60U and 60L can consist of a single piece or several pieces of any other material that is strong and rigid enough to hold electric motor 50 in predetermined position specific to a particular make and model of press and provide uninhibited operation of the press.

In the preferred embodiment as illustrated in FIG. 2, upper motor shaft 70U extends out of the top of electric motor 50 and lower motor shaft 70L (not shown) extends out of the bottom of electric motor 50. Drive wheel 80 having a predetermined outside diameter with a grove around its perimeter is mounted by means of a press fit with its inner bore on upper motor shaft 70U. Upper motor shaft 70U extends far enough from electric motor 50 as to allow a predetermined amount of coaxial positioning of drive wheel 80.

The perimeter grove on drive wheel 80 is shaped in such a fashion as to accept the cross sectional profile of drive belt 90. Drive belt 90 can have a round, rectangular, or V-type cross section and is made of any strong, elastic, and flexible material applicable to belt-driven mechanisms. In addition to drive wheel 80, drive belt 90 is mounted on driven wheel 100. Driven wheel 100 is similar drive wheel 80 and attaches to the top of die assembly 10 (see below) with internal threads along its inner bore.

Lower motor shaft 70L (not shown) extends out of the bottom of electric motor 40, and attaches to vacuum generating apparatus 110. Vacuum generating apparatus 110 has a shrouded impeller mechanism (not shown) an air intake 110.01 and an exhaust 110.02. Vacuum generating apparatus 110 is similar to those common in the Heating Ventilation and Air Conditioning (HVAC) industry, which requires an electric motor to supply rotational force in order to generate a vacuum. Air intake 110.01 is connected to die assembly 10 by means of vacuum hose 120. Vacuum hose 120 is of a flexible material and has a predetermined internal diameter such that it may slide onto the appropriate fittings of die assembly 10 and air intake 110.01 while remaining sufficiently air-tight.

DESCRIPTION: FIG 3 THROUGH FIG. 7

A typical embodiment of die assembly 10 is illustrated in FIG. 3. while details and internal workings of die assembly 10 are shown in FIG. 4 through FIG. 6. As seen from FIG. 4, die assembly 10 includes a coaxial shaft 10.01, a combination radial/thrust roller bearing 10.02, a bearing cap 10.03, an upper hexagonal nut 10.04U, a lower hexagonal nut 10.04L, a radial type ball bearing 10.05, a spacer washer 10.06, a shield washer 10.07, a trimming/milling cutter 10.08, a guide member 10.09, an interlocking decapping pin 10.10, a sizing ring insert 10.11, a multi-ported die body 10.12, a manifold 10.13, and a vacuum hose adapter 10.14.

In the preferred embodiment as illustrated in FIG. 4 and FIG. 5, coaxial shaft 10.01 is externally threaded and is of a predetermined length and diameter, as to extend out of and above the rest of die assembly 10 a sufficient amount to coaxially mount and support driven wheel 100. Coaxial shaft 10.01 provides the axis of rotation of all rotating parts of die assembly 10. Driven wheel 100 has a spacer shaft 100.01 of a predetermined length and diameter that extends from the bottom side of driven wheel 100 which acts as a spacer between the rotation of driven wheel 100 and the non-rotating exterior of die assembly 10. The bottom face of spacer shaft 100.01 extends down to the top face of the inner bore of combination radial/thrust roller bearing 10.02.

Combination radial/thrust roller bearing 10.02 is of the double shielded type with an predetermined internal bore to receive the external diameter of coaxial shaft 10.01. Combination radial/thrust roller bearing 10.02 has a predetermined external diameter greater than the diameter of the internal bore of multi-ported die body 10.12 (described in detail below) such that coaxial shaft 10.01 and everything affixed to coaxial shaft 10.01, is supported vertically by the top of multi-ported die body 10.12. Combination radial/thrust roller bearing 10.02 is secured to the top of multi-ported die body 10.12 by bearing cap 10.03.

Bearing cap 10.03 is provided an exterior diamond knurl 10.03.01, while the top face is flat. Bearing cap 10.03 is provided with a small through-hole bore 10.03.02 of a predetermined size slightly larger than the external diameter of spacer shaft 100.01 on driven wheel 100. A larger bearing bore 10.03.03 is of a predetermined size to accept the external diameter of combination radial/thrust roller bearing 10.02. A threaded lower portion 10.03.04 in bearing cap 10.03 is provided with internal threads and sized to threadedly mate with the external threads of multi-ported die body 10.12 (see below).

Combination radial/thrust roller bearing 10.02 is secured to coaxial shaft 10.01 from below by upper hexagonal nut 10.04U. Upper hexagonal nut 10.04U is internally threaded to receive the external threads of coaxial shaft 10.01. When proper torque is applied to upper hexagonal nut 10.04U, coaxial shaft 10.01, driven wheel 100, and combination radial/thrust roller bearing 10.02 are effectively secured together in the same relative position. Coaxial shaft 10.01 and everything attached to it, is free to rotate but will not move radially or axially.

Lower hexagonal nut 10.04L is identical to upper hexagonal nut 10.04U. Lower hexagonal nut 10.04L positions and secures parts mounted to the lower portions of coaxial shaft 10.01. Immediately below lower hexagonal nut 10.04L is the top face of the inner bore of radial type ball bearing 10.05. Radial type ball bearing 10.05 has a predetermined internal bore to receive the external diameter of coaxial shaft 10.01 and a predetermined external diameter slightly less than the internal bore of multi-ported die body 10.12. Radial type ball bearing 10.05 is of the sealed or double-shielded type and provides radial support to the lower portion of coaxial shaft 10.01. The bottom face of the inner bore of the radial type ball bearing 10.05 is supported from below by spacer washer 10.06.

Spacer washer 10.06 has a predetermined internal bore to receive the external diameter of coaxial shaft 10.01 and a predetermined external diameter less than the internal bore of multi-ported die body 10.12. Spacer washer 10.06 provides clearance between radial type ball bearing 10.05 and shield washer 10.07. Shield washer 10.07 has a predetermined internal bore to receive the external diameter of coaxial shaft 10.01 and a predetermined external diameter similar to but slightly less than the internal bore of multi-ported die body 10.12. Shield washer 10.07 helps to protect radial type ball bearing 10.05 by acting as a physical barrier against any cartridge case chips produced in the trimming process. The bottom face of shield washer 10.07 is flush with the top face of trimming/milling cutter 10.08.

As illustrated in FIG. 4, FIG. 5, and FIG. 6, trimming/milling cutter 10.08 is of a cylindrically shaped case-hardened high-speed steel, carbide, or some other appropriate material suitable for trimming cartridge case material. Trimming/milling cutter 10.08 has an upper internally threaded bore 10.08.01 of sufficient diameter and depth as to allow a predetermined variable amount of coaxial positioning with respect to the lower end of coaxial shaft 10.01. The outside diameter of trimming/milling cutter 10.08 is of a predetermined size greater than that of cartridge case 40 and less than the internal bore of multi-ported die body 10.12 (see below), such that sufficient air-flow can be maintained by vacuum generating apparatus 110 to allow for the evacuation of case trimmings. Shown in FIG. 6, the bottom face of trimming/milling cutter 10.08 has a number of radial cutting edges 10.08.02 machined into it, such that when case mouth 40.01 is brought into contact with the rotating cutting edges, cartridge case 40 will be uniformly trimmed to length. At the center of the bottom face of trimming/milling cutter 10.08 is a lower internally threaded bore 10.08.01 of predetermined size such that a externally threaded shaft 10.09.01 of guide member 10.09 can be secured in coaxial position.

Guide member 10.09 is uniquely shaped to function with a specific cartridge case caliber. Positioned on the upper portion of guide member 10.09 is externally threaded shaft 10.09.01 of predetermined size such that guide member 10.09 can be secured in coaxial position with the bottom face of trimming/milling cutter 10.08. Guide member 10.09 has a cylindrical contour 10.09.02 of a predetermined size and shape (unique for each specific caliber) such that while rotating, it may be easily inserted into case mouth 40.01 of cartridge case 40. Guide member 10.09 guides trimming/milling cutter 10.08, and keeps cartridge case 40 radially stationary. At the bottom end of guide member 10.09 is an internal bore 10.09.03 of predetermined size to receive the external diameter of interlocking decapping pin 10.10.

As illustrated by the preferred embodiment in FIG. 7, interlocking decapping pin 10.10 has a predetermined external diameter of sufficient size to pass through a flash hole 40.02 (cartridge case ignition port) of cartridge case 40. Interlocking decapping pin 10.10 is formed in such a fashion as to produce a number of protrusions 10.10.01, that while rotating will interlock with a set of anvil arms 130.01 in a spent primer 130. As illustrated in FIG. 6, interlocking decapping pin 10.10 extends below multi-ported die body 10.12 and sizing ring insert 10.11.

Sizing ring insert 10.11 is precisely and uniquely sized for use with a specific cartridge case caliber. Sizing ring insert 10.11 is made of hardened steel, carbide, tungsten-carbide, or any material appropriate for resizing the exterior diameter of a cartridge case. Sizing ring insert 10.11 has a slightly tapered and filleted inner bore (smallest at the top) of a predetermined size specific to a given cartridge case caliber. The top face of sizing ring insert 10.11 is smooth while the bottom face provided with a number of radial slots 10.11.01 of a predetermined width, depth, and position as to accept the forks of an appropriately sized spanner wrench. The outer diameter of sizing ring insert 10.11 is externally threaded and sized to threadedly mate with a section of internal threads 10. 12.01 of multi-ported die body 10.12.

As illustrated in FIG. 4, FIG. 5, and FIG. 6, multi-ported die body 10.12 is cylindrically shaped with a mostly smooth internal bore of a predetermined diameter and length, except for a section of internal threads 10.12.01 along its lower portion so as to accept sizing ring insert 10.11. FIG. 6 shows a number of radial air-intake holes (ports) 10.12.02 of predetermined size and position which are machined through the lower walls of multi-ported die body 10.12 so as to remain below press toolhead 20 and not interfere with the function of sizing ring insert 10.11. Multi-ported die body 10.12 is provided with external threads along its entire length and sized to threadedly mate with the threaded opening in press toolhead 20. FIG. 5 illustrates a number of radial air-evacuation holes (ports) 10.12.03 of predetermined size and position which are machined through the approximate mid-section walls of multi-ported die body 10.12 so as to be above a lower internally threaded opening 10.13.01 in the bottom of manifold 10. 13 and yet remain below the vertical position of shield washer 10.07.

As illustrated in FIG. 5, manifold 10.13 is cylindrically shaped with a recessed internal bore 10.13.02 along all but a predetermined amount at the top and bottom. The bottom and top sections of the internal bore in manifold 10.13 which are not recessed, have internal threads sized to threadedly mate with external threads of multi-ported die body 10.12. The top and bottom faces of manifold 10.13 are machined flat. Manifold 10.13 is supplied with a number radial holes (ports) 10.13.03 of predetermined size and position around its outside periphery. Manifold 10.13 provides radial support for the upper end of die assembly 10, supports an air chamber such that all radial air-evacuation holes (ports) 10.12.03 of multi-ported die body 10.12 maintain an air-flow, and manifold 10.13 secures the axial position of multiported die body 10.12 on press toolhead 20. The external surface of manifold 10.13 is sized to accept the internal bore of vacuum hose adapter 10.14 with a sufficiently air-fight fit.

As shown in FIG. 3. FIG. 4, and FIG. 5, vacuum hose adapter 10.14 is made of plastic, nylon, or some other suitable material common to vacuum hose fittings. Vacuum hose adapter 10.14 consists of two cylindrical sections manufactured as one piece. A vertical cylindrical section 10.14.01 of predetermined size and length is provided with an internal bore through its entire length that is sized to slip over the exterior of manifold 10.13 and provide a sufficiently air-tight fit, while the exterior diameter of vertical cylindrical section 10.14.01 is sized for adequate strength and yet provide the smallest possible exterior profile. A horizontal cylindrical section 10.14.02 of vacuum hose adapter 10.14 is provided with a external diameter sized to provide a sufficiently air-fight fit with the interior diameter of vacuum hose 120, while the internal bore of horizontal cylindrical section 10.14.02 is of a predetermined size intersects with the internal bore of vertical cylindrical section 10.14.01 to allow the free flow of air. Vacuum hose adapter 10.14 provides the vacuum connection between die assembly 10 and vacuum hose 120 and may be oriented in virtually any radial position as to keep from interfering with any other attachments mounted on press toolhead 20.

OPERATION OF INVENTION: FIGS. 1, 2, 4, 5, 6 & 7

The manner of using the multifunctional cartridge case processing apparatus is similar to that of cartridge case resizing dies in present use. The user operates a press handle 30.04 as with a conventional resizing-/decapping die (not shown). Assuming proper installation and adjustment of the multifunctional cartridge case processing apparatus, power would be supplied to electric motor 50. As the motor turns, upper motor shaft 70U turns drive wheel 80. Drive wheel 80 supplies belt drive 90 with rotational force which rotates driven wheel 100. Driven wheel 100 rotates coaxial shaft 10.01 and everything affixed to coaxial shaft 10.01. Combination radial/thrust roller bearing 10.02 and radial type ball bearing 10.05 support coaxial shaft 10.01 both radially and axially. While the coaxial shaft 10.01 rotates, trimming/milling cutter 10.08, guide member 10.09, and interlocking decapping pin 10.10 rotate also.

As electric motor 50 supplies rotation to die assembly 10 through upper motor shaft 70U, lower motor shaft 70L (not shown) turns the vacuum generating apparatus 110. When rotating, vacuum generating apparatus 110 transfers its suction through vacuum hose 120, vacuum hose adapter 10.14, and manifold 10.13. The ports in manifold 10.13 and radial air-evacuation holes (ports) 10.12.03 transfer the vacuum suction to trimming/milling cutter 10.08, and radial air-intake holes (ports) 10.12.02 allow a continuous air-flow through die assembly 10.

With the apparatus operating, the operator pulls press handle 30.04 down and ram mechanism 30.03 mechanically forces cartridge case 40 into die assembly 10. Case mouth 40.01 of cartridge case 40 would pass through sizing ring insert 10.11, starting the resizing of the external diameter of the cartridge case 40. As cartridge case 40 continues its upward travel, the rotating protrusions 10.10.01 of interlocking decapping pin 10.10 come in contact and interlock with anvil arms 130.01 of spent primer 130. Together the axial and rotational forces of interlocking decapping pin 10.10 drive and spin spent primer 130 out of case primer pocket 40.03. While spent primer 130 spins, anvil arms 130.01 scrap away a primer residue 40.04, effectively cleaning primer pocket 40.03. With further upward travel of cartridge case 40, spent primer 130 clears the side-walls of primer pocket 40.03, loses radial support, and drops off interlocking decapping pin 10.10.

As cartridge case 40 completes its upward movement, guide member 10.09 enters and supports the inside of case mouth 40.01. At this point, case mouth 40.01 and any excess axial elongation of cartridge case 40 come in contact with radial cutting edges 10.08.02 of the rotating himming/milling cutter 10.08. Trimming-/milling cutter 10.08 trims the cartridge case 40 to a consistent precise length and the case trimmings are thrown radially outward. When the case trimmings (metal flakes) come in contact with the continuous air-flow supplied by vacuum generating apparatus 110, the flakes are evacuated through the porting of die assembly 10, into and through vacuum hose 120, and exit the apparatus through exhaust 110.02.

Lastly, the operator pulls up on press handle 30.04 removing cartridge case 40 from die assembly 10. Cartridge case 40 is now resized to its original standard diameter and length. Primer pocket 40.03 is decapped and clean.

CONCLUSION, RAMIFICATIONS, AND SCOPE:

Accordingly, the multifunctional cartridge case processing apparatus of this invention can be used to combine several operations into a single step of the overall handloading/reloading process. This combination of steps reduces the time and effort required to load (reload) ammunition. In addition, the placement of the motor, the small external profile of the die assembly, and the flexible radial orientation of the vacuum hose, allow the multifunctional cartridge case processing apparatus to be used on a single-stage or progressive handloading/reloading press. Thus, effectively integrating the process of trimming cartridge cases and cleaning the primer pockets into the sequence of progressive handloading/reloading. Different calibers of ammunition as well as the shortest pistol cases can be reloaded by attaching the appropriate guide member and sizing ring, and then adjusting the trimming cutter height by moving it up or down the coaxial shaft. Therefore, if someone handloads/reloads several different calibers, the multifunctional cartridge case processing apparatus will save them money because only two interchangeable parts are needed while the main apparatus can be used for a wide variety of calibers. Further cost saving will be realized by those who use this invention because of the extended life of the cartridge cases, which in turn motivates shooters to pick up spent cases thereby reducing waste. Cartridge cases processed by the multifunctional cartridge case processing apparatus will have the precisely same length, for reasons discussed above, the handloaded/reloaded ammunition will be safer and have less variance in point of impact from shot to shot. In short, the multifunctional cartridge case processing apparatus will make handloading-/reloading:

(a) safer;
(b) more consistent,
(c) more versatile;
(d) more ecological;
(e) cheaper;
(f) faster; and
(g) easier.

While the above description contains many specificities, these should not be construed as limitations on the scope of the invention, but rather as an exemplification of one preferred embodiment thereof.

Many other variations are possible. For example:

1. the electric motor could have a single shaft on one side of the motor that drives both the cutter mechanism and the vacuum generating apparatus;
2. the position of the vacuum attachment could be above the press toolhead as shown, or it may be situated below the toolhead, facilitating easier removal of the cartridge case trimmings;
3. the belt drive mechanism could be replaced by many different rotational energy connecting elements (gear train, cable, rotating shaft, etc.);
4. both the drive wheel and/or the driven wheel could be attached to their respective shafts with a keyway, press-fit, threads, etc.;
5. several types and numbers of bearings or bushings can be used to support the coaxial shaft inside the die assembly;
6. the trimming/milling cutter could have several configurations such as having impeller blades along its periphery to facilitate the evacuation of case trimmings;
7. the guide member could be machined with external splines such that the inside of the case mouth is chamfered while the cartridge case is trimmed;
8. the upper end of the interlocking decapping pin could be threaded, keyed, press-fit, etc., to assure fixed positioning with the guide member;
9. the lower end of the interlocking decapping pin could be smooth or have threads, forks, lobes, etc.; such that locking contact is made with the primer, and the interlocking decapping pin could have some type of (wire, nylon, etc.) bristles positioned in such a way as to clean the primer pocket when inserted through the flash hole;
10. the apparatus can be manufactured and sold to be totally caliber specific and/or such that the multiported die body, the trimming/milling cutter, or any other component or combination of components are specific to a given cartridge caliber; and
11. the manifold and the vacuum attachment could possibly be integrated into a single part. Accordingly, the scope of the invention should be determined not by the embodiment(s) illustrated, but by the appended claims and their legal equivalents.

I claim:

1. A multifunctional cartridge case processing apparatus adapted for use on a frame and a toolhead of a handloading/reloading press, comprising:

(a) a die body comprised of a cylindrical body of material having an internal coaxial bore, a means whereby an air flow may be introduced and maintained therethrough said internal coaxial bore of said die body while said die body is being used to resize a cartridge case, a sizing ring section in a lower end of said die body comprised of a cylindrical body of a material suitable for resizing a cartridge case having a hole disposed coaxial with said internal coaxial bore into which hole said cartridge case is pressed to size it and from which said cartridge case is withdrawn, an external thread on said die body to threadedly mate with said toolhead;
(b) a externally threaded coaxial shaft comprised of a cylindrical body of material to be coaxially mounted inside said internal coaxial bore of said die body;
(c) a means to provide radial and coaxial support to said externally threaded coaxial shaft while said externally threaded coaxial shaft is mounted inside said internal coaxial bore of said die body;
(d) a trimming culler of a body of material suitable for machining said cartridge case while coaxially mounted inside said internal coaxial bore of said die body, an upper internally threaded coaxial bore of predetermined size and depth in an upper face of said trimming cutter to threadedly mate with said externally threaded coaxial shaft and provide a predetermined amount of coaxial positioning with respect to said externally threaded coaxial shaft, a cylindrical surface of said trimming cutter of predetermined size and shape to maximize said air flow through said internal coaxial bore of said die body while said trimming cutter is mounted coaxially inside said internal coaxial bore of said die body, a surface on a lower face of said trimming cutter to provide a means of trimming said cartridge case disposed therethrough said sizing ring section of said die body while said trimming cutter is mounted coaxially to and rotating inside said internal coaxial bore of said die body, a lower internally threaded coaxial bore of predetermined size in said lower face of said trimming cutter;

(e) a guide member comprised of a contoured cylindrical body of material with an upper externally threaded coaxial shaft of predetermined size to threadedly mate with said lower internally threaded coaxial bore of said trimming cutter, a contoured coaxial external diameter along a periphery of said guide member to provide a means which facilitates insertion of said guide member into said cartridge case disposed therethrough said sizing ring section of said die body thereby providing radial support to said cartridge case, a lower coaxial bore in said guide member; and (f) a decapping pin comprised of a cylindrical body of a material with an upper end formed to mount inside said lower coaxial bore of said guide member and to remain stationary with respect to said guide member, an external diameter of said decapping pin of a predetermined size as to allow insertion through a flash hole of said cartridge case, a lower end of said decapping pin formed to facilitate the removal of a spent primer from said cartridge case.

2. The apparatus of claim 1, further including:

(a) a motor of a predetermined speed and power rating to provide sufficient rotational force to said multifunctional cartridge case processing apparatus of claim 1;

(b) a means to mount said motor to said frame of claim 1;

(c) a rotational energy connecting element from said motor to said externally threaded coaxial shaft of claim 1;

(d) a vacuum generating apparatus to create said air flow of claim 1, (e) a rotational energy connecting element from said motor to said vacuum generating apparatus; and (f) a means to connect said air flow of claim I created by said vacuum generating apparatus to said die body of claim 1.

3. A method of processing an ammunition cases with a single apparatus integrating the separate operations of resizing said ammunition case, trimming said ammunition case to length, evacuating said ammunition case trimmings, and decapping a detonated primer from said ammunition case, comprising the steps of:

(a) inserting said ammunition case into a sizing die, (b) decapping of said detonated primer from said ammunition case with a depriming pin mounted coaxially therethrough said sizing die, (c) trimming said ammunition case to length with a rotating milling cutter mounted coaxially therein said sizing die, powered by an electric vacuum motor, and (d) evacuating said ammunition case trimmings by means of a suction produced by said electric vacuum motor.

* * * * *